US010789967B2

(12) United States Patent
Yang et al.

(10) Patent No.: US 10,789,967 B2
(45) Date of Patent: Sep. 29, 2020

(54) NOISE DETECTION AND NOISE REDUCTION

(71) Applicants: HARMAN INTERNATIONAL INDUSTRIES, INCORPORATED, Stamford, CT (US); Dong Yang, Xuhui District Shanghai (CN); Zhengliang Xue, Xuhui District Shanghai (CN); Lan Mao, Xuhui District Shanghai (CN)

(72) Inventors: Dong Yang, Xuhui District Shanghai (CN); Zhengliang Xue, Xuhui District Shanghai (CN); Lan Mao, Xuhui District Shanghai (CN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/097,540

(22) PCT Filed: May 9, 2016

(86) PCT No.: PCT/CN2016/081454
§ 371 (c)(1),
(2) Date: Oct. 29, 2018

(87) PCT Pub. No.: WO2017/193264
PCT Pub. Date: Nov. 16, 2017

(65) Prior Publication Data

US 2019/0156851 A1 May 23, 2019

(51) Int. Cl.
*G10L 21/0232* (2013.01)
*H04R 1/10* (2006.01)
(Continued)

(52) U.S. Cl.
CPC ..... *G10L 21/0232* (2013.01); *G10L 25/51* (2013.01); *H04R 1/1041* (2013.01);
(Continued)

(58) Field of Classification Search
CPC ..... H04R 17/00; H04R 1/028; H04R 3/00; H04R 3/007; H04R 1/1041;
(Continued)

(56) References Cited

U.S. PATENT DOCUMENTS 3,588,385 A * 6/1971 Moye ..... H04B 3/23 370/290
5,251,263 A * 10/1993 Andrea ..... G10K 11/1784 381/71.6
(Continued)

FOREIGN PATENT DOCUMENTS

CN 1488136 A 4/2004
CN 1956058 A 5/2007
(Continued)

OTHER PUBLICATIONS

Myung Jeon, K. et al., "Two-stage Impulsive Noise Detection Using Inter-frame Correlation and Hidden Markov Model for Audio Restoration", AES convention 136, Apr. 2014, 5 pages.
(Continued)

*Primary Examiner* — Lun-See Lao
(74) *Attorney, Agent, or Firm* — Brooks Kushman P.C.

(57) ABSTRACT

A noise detection method and a noise detection system are provided. The noise detection method includes: obtaining an audio signal; comparing the audio signal with a wave of a noise model to obtain a correlation value; and identifying whether the audio signal is a candidate noise signal based on the correlation value. The method can detect plugging noises effectively.

19 Claims, 5 Drawing Sheets

(51) Int. Cl.

| | |
|---|---|
| ***H04R 3/00*** | (2006.01) |
| ***G10L 25/51*** | (2013.01) |
| ***G10L 25/45*** | (2013.01) |
| ***G10L 25/06*** | (2013.01) |

(52) U.S. Cl.
CPC ..... *H04R 3/007* (2013.01); *G10L 25/06* (2013.01); *G10L 25/45* (2013.01); *H04R 2420/05* (2013.01)

(58) Field of Classification Search
CPC ..... H04R 2400/01; H04R 2420/05; H04R 2430/01; H04R 2499/11; H04R 29/001; H04R 3/002; H04R 3/04; H04J 11/0033; H04L 25/0228; H04L 12/40032; H04L 1/0071; H03H 21/0012
USPC ..... 381/74, 94.1–94.5, 1–3, 56–58, 13, 67
See application file for complete search history.

(56) References Cited

U.S. PATENT DOCUMENTS

2004/0064307 A1 4/2004 Scalart et al.
2006/0100868 A1 5/2006 Hetherington et al.
2008/0152169 A1* 6/2008 Asada ..... H04R 5/04 381/107
2009/0177466 A1 7/2009 Rui et al.
2010/0302033 A1* 12/2010 Devenyi ..... H04R 1/1041 340/540
2011/0255710 A1* 10/2011 Toyama ..... H04R 3/007 381/94.4
2013/0191118 A1 7/2013 Makino
2013/0236025 A1* 9/2013 Ma ..... H04R 3/007 381/74
2014/0270252 A1* 9/2014 Pahuja ..... G10L 21/0208 381/94.5

FOREIGN PATENT DOCUMENTS

JP H11108908 A 4/1999
WO 2017193264 A1 11/2017

OTHER PUBLICATIONS

Supplementary Partial European Search Report for corresponding Application No. 16901219.2, dated Sep. 25, 2019, 15 pages.
English Translation of Chinese Office Action for Application No. 201680085420.1, dated May 28, 2020, 19 pages.

* cited by examiner

NOISE DETECTION AND NOISE REDUCTION

CROSS-REFERENCE TO RELATED APPLICATION

This application is the U.S. national phase of PCT Application No. PCT/CN2016/081454 filed on May 9, 2016, the disclosures of which is incorporated in its entirety by reference herein.

TECHNICAL FIELD

The present disclosure generally relates to noise detection and noise reduction.

BACKGROUND

Nowadays, audio players, such as headphones and loudspeakers, have been widely used for listening to audio sources. However, in daily usage, users generally are unable to listen to music with clear sounds quietly due to interferences from the noises. Active noise-cancellation (ANC) technique has been developed to improve headphone or loudspeaker performances. An ANC headphone has a microphone disposed therein for capturing background noises and correspondingly generating a noise-cancellation signal, so as to eliminate the background noises. However, the ANC headphone cannot detect and eliminate a plugging noise which is generated when an audio plug is being plugged into an audio socket. Therefore, there is a need for a noise detection method to detect and reduce the plugging noise.

SUMMARY

In one embodiment, a noise detection method is provided. The method includes: obtaining an audio signal; comparing the audio signal with a wave of a noise model to obtain a correlation value; and identifying whether the audio signal is a candidate noise signal based on the correlation value.

In some embodiments, comparing the audio signal with a wave of a noise model to obtain a correlation value includes: convoluting the audio signal with the wave of the noise model to obtain the correlation value.

In some embodiments, the noise model is a Gaussian window function or a Marr window function.

In some embodiments, parameters of the Gaussian window function or the Marr window function are extracted from a plurality of plugging noise samples.

In some embodiments, determining whether the audio signal is a candidate noise signal based on the correlation value includes: obtaining a ratio of the correlation value to an energy value of the audio signal; comparing the ratio with a first threshold value; and if the ratio is greater than the first threshold value, identifying the audio signal to be a candidate noise signal; or otherwise, identifying the audio signal not to be a candidate noise signal.

In some embodiments, the first threshold value is obtained based on a plurality of plugging noise samples.

In some embodiments, if the audio signal is identified to be a candidate noise signal, the method further includes: obtaining an exponential discharge index of the candidate noise signal; comparing the exponential discharge index with a second threshold value; and if the exponential discharge index is smaller than the second threshold value, identifying the candidate noise signal to be a noise signal; or otherwise, identifying the candidate noise signal not to be a noise signal.

In some embodiments, obtaining an exponential discharge index of the candidate noise signal includes: calculating derivative of the candidate noise signal to obtain a derivative function; calculating logarithm of an absolute value of the derivative function to obtain a logarithm function; and calculating derivative of the logarithm function to obtain the exponential discharge index of the candidate noise signal.

In some embodiments, the second threshold value is obtained by calculating an average value of exponential discharge indexes of a plurality of plugging noise samples.

In one embodiment, a noise reduction method is provided. The method includes: obtaining an audio signal; comparing the audio signal with a wave of a noise model to obtain a correlation value; identifying whether the audio signal is a noise signal based on the correlation value; and performing a noise reduction process on the audio signal if the audio signal is identified to be a noise signal.

In some embodiments, the noise reduction process includes a fade-out process and a fade-in process.

Correspondingly, a noise detection system is also provided. The system includes a processing device configured to: obtain an audio signal; compare the audio signal with a wave of a noise model to obtain a correlation value; and identify whether the audio signal is a candidate noise signal based on the correlation value.

In some embodiments, the processing device is further configured to convolute the audio signal with the wave of the noise model to obtain the correlation value.

In some embodiments, the noise model is a Gaussian window function or a Marr window function.

In some embodiments, parameters of the Gaussian window function or the Marr window function are extracted from a plurality of plugging noise samples.

In some embodiments, the processing device is further configured to: calculate a ratio of the correlation value to an energy value of the audio signal; compare the ratio with a first threshold value; and if the ratio is greater than the first threshold value, identify the audio signal to be a candidate noise signal; or otherwise, identify the audio signal not to be a candidate noise signal.

In some embodiments, the first threshold value is extracted from a plurality of plugging noise samples.

In some embodiments, if the audio signal is identified to be a candidate noise signal, the processing device is further configured to: obtain an exponential discharge index of the candidate noise signal; compare the exponential discharge index with a second threshold value; and if the exponential discharge index is smaller than the second threshold value, identify the candidate noise signal to be a noise signal; or otherwise, identify the candidate noise signal not to be a noise signal.

In some embodiments, the processing device is further configured to: calculate derivative of the candidate noise signal to obtain a derivative function; calculate logarithm of an absolute value of the derivative function to obtain a logarithm function; and calculate derivative of the logarithm function to obtain the exponential discharge index of the candidate noise signal.

In some embodiments, the second threshold value is obtained by calculating an average value of exponential discharge indexes of a plurality of plugging noise samples.

In some embodiments, the processing device is integrated in a headphone or a loudspeaker.

By employing the noise detection method and the noise reduction method described above, the plugging noise can be detected and reduced from the audio signal effectively, which improves the performances of the audio player.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
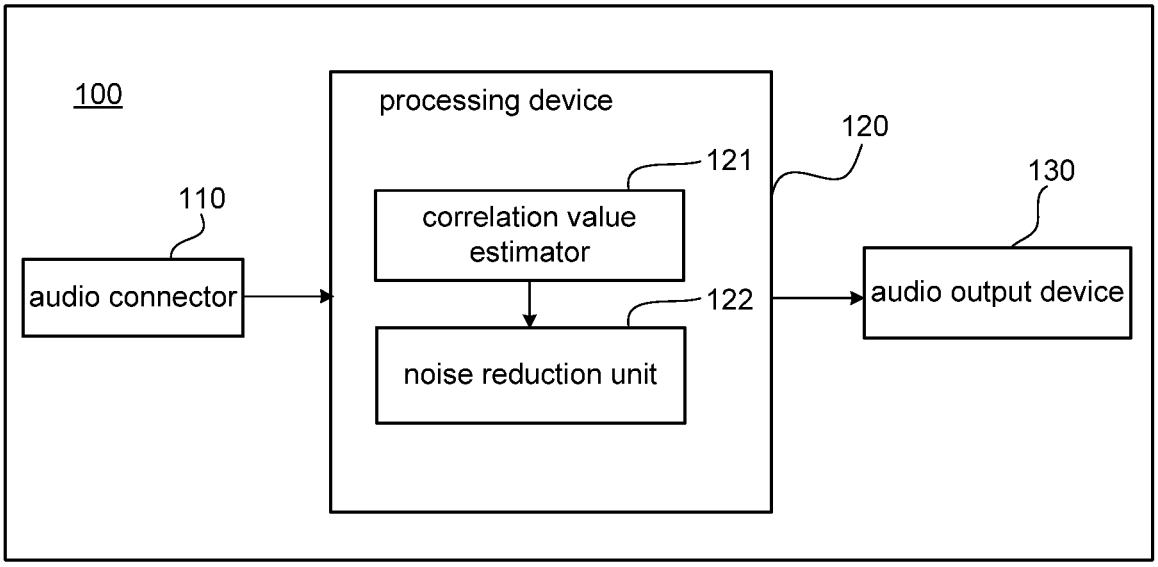
FIG. 1 schematically illustrates a block diagram of an audio player with a noise detection system according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

FIG. 1 is a schematic block diagram of an audio player with a noise detection system according to an embodiment of the present disclosure.

Referring to FIG. 1, the audio player 100 includes an audio connector 110, a processing device 120 and an audio output device 130.

Figure 2:
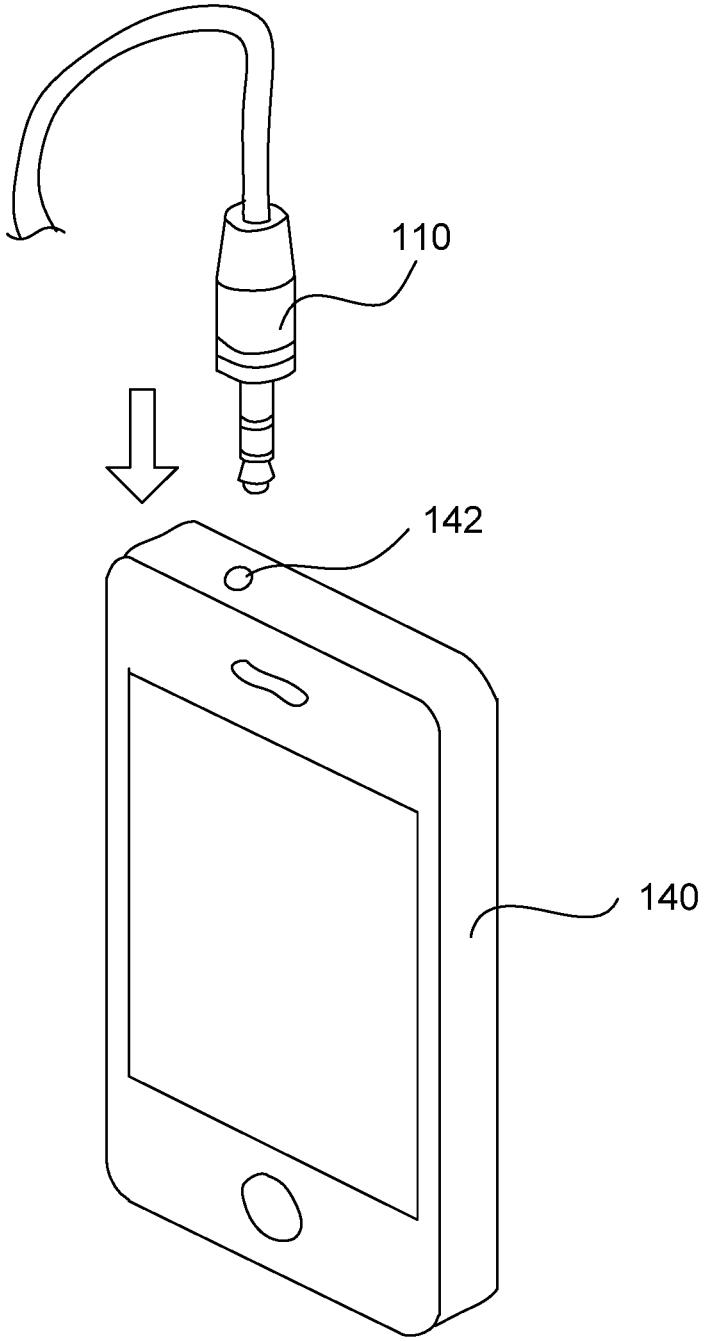
FIG. 2 schematically illustrates a diagram of an audio connector and an audio source according to an embodiment.

The audio connector 110 is used to connect with an audio source for receiving audio signals. For example, the audio connector 110 may be an audio plug. The audio plug may be used to plug into an audio socket of an audio source. The audio source may be a mobile phone, a music player, a radio receiver, etc. Referring to FIG. 2, taking a mobile phone as an example, when the audio plug 110 is being plugged into an audio socket 142 of a mobile phone 140, a plugging noise may be generated by electrical charge and discharge between the audio plug 110 and the audio socket 142, and then the plugging noise may be transmitted to the audio output device 130.

The processing device 120 is configured to detect and reduce the plugging noise. The audio output device 130 is configured to play a processed audio signal received from the processing device 120, such that the performance of the audio player 100 can be improved. In some embodiments, the audio player 100 may be a headphone or a loudspeaker. That is, the audio connector 110, the processing device 120 and the audio output device 130 may be integrated together as an audio device, for example, a headphone or a loudspeaker. In some embodiments, the audio connector 110 and the audio output device 130 may be connected with the processing device 120 through a wire. In some embodiments, the processing device 120 may be an integrated circuit, a CPU, a MCU, a DSP, etc.

Referring to FIG. 1, in some embodiments, the processing device 120 includes a correlation value estimator 121 and a noise reduction unit 122.

The correlation value estimator 121 obtains an audio signal from an audio source through the audio connector 110, and compares the audio signal with a wave of a noise model to obtain a correlation value. In some embodiments, the correlation value estimator 121 convolutes the audio signal with the wave of the noise model.

In some embodiments, the noise model is a Gaussian window function. The correlation value estimator 121 convolutes the audio signal with the Gaussian window function to obtain the correlation function. Then the correlation value estimator 121 identifies whether the audio signal is a candidate noise signal based on the correlation value. For example, the correlation value estimator 121 may calculate a ratio of the the correlation value to an energy value of the audio signal, and compare the ratio with a first threshold value. If the ratio is greater than the first threshold value, the correlation value estimator 121 identifies the audio signal to be a candidate noise signal; or otherwise, the correlation value estimator 121 identifies the audio signal not to be a candidate noise signal.

In some embodiment, the correlation value can be obtained according to the following equation:

$$P(t)=\mathrm{conv}(G(t,a),S(t));$$

where P(t) represents a correlation function, cony represents a convolution operation, S(t) represents the audio signal, G(t, a) represents the Gaussian window function, and t represents time. The convolution operation produces the correlation function P(t), which is typically viewed as a modified version of the audio signal S(t), giving the integral of the pointwise multiplication of the two functions as a function of time. Then, the correlation value can be obtained by sampling the correlation function P(t).

The Gaussian window function is a mathematical function that is zero-valued outside of a chosen interval. In some embodiments, the Gaussian window function can be expressed as the following equation:

$$\begin{cases} G(t,a)=\dfrac{1}{\sqrt{2\pi}\,\sigma}\exp\left(-\dfrac{(t-\mu)^2}{2\sigma^2}\right)\left(-\dfrac{a}{2}\le t\le\dfrac{a}{2}\right) \\ G(t,a)=0\ \left(t<-\dfrac{a}{2},\ t>\dfrac{a}{2}\right) \end{cases};$$

where G(t, a) represents the Gaussian window function, t represents time, a represents a length of the Gaussian window function, μ represents an expected value of G(t, a), and $\sigma^2$ represents a variance of G(t, a). The above parameters may be extracted from a plurality of plugging noise samples, such that the Gaussian window function may has a similar waveform to a plugging noise. For example, the Gaussian window function may have a length ranging from 1 ms to 50 ms, which is a typical length of plugging noises. In some embodiments, the length of the Gaussian window function may be 1.6 ms, 4 ms, 9 ms, 25 ms, etc.

As the parameters of the Gaussian window function has a similar waveform to a plugging noise, after the audio signal is convoluted with the Gaussian window function, the correlation function may have a big correlation peak at a time point corresponding to the plugging noise. In one embodiment, referring to FIG. 3, the upper curve illustrates an audio signal, the middle curve illustrates its corresponding correlation function, and the bottom curve illustrates a ratio between the energy of the audio signal and the correlation value. It can be found from FIG. 3, the correlation function has a correlation peak around the time point of 5 s. That is, there may be a candidate noise signal around the time point of 5 s.

Figure 3:
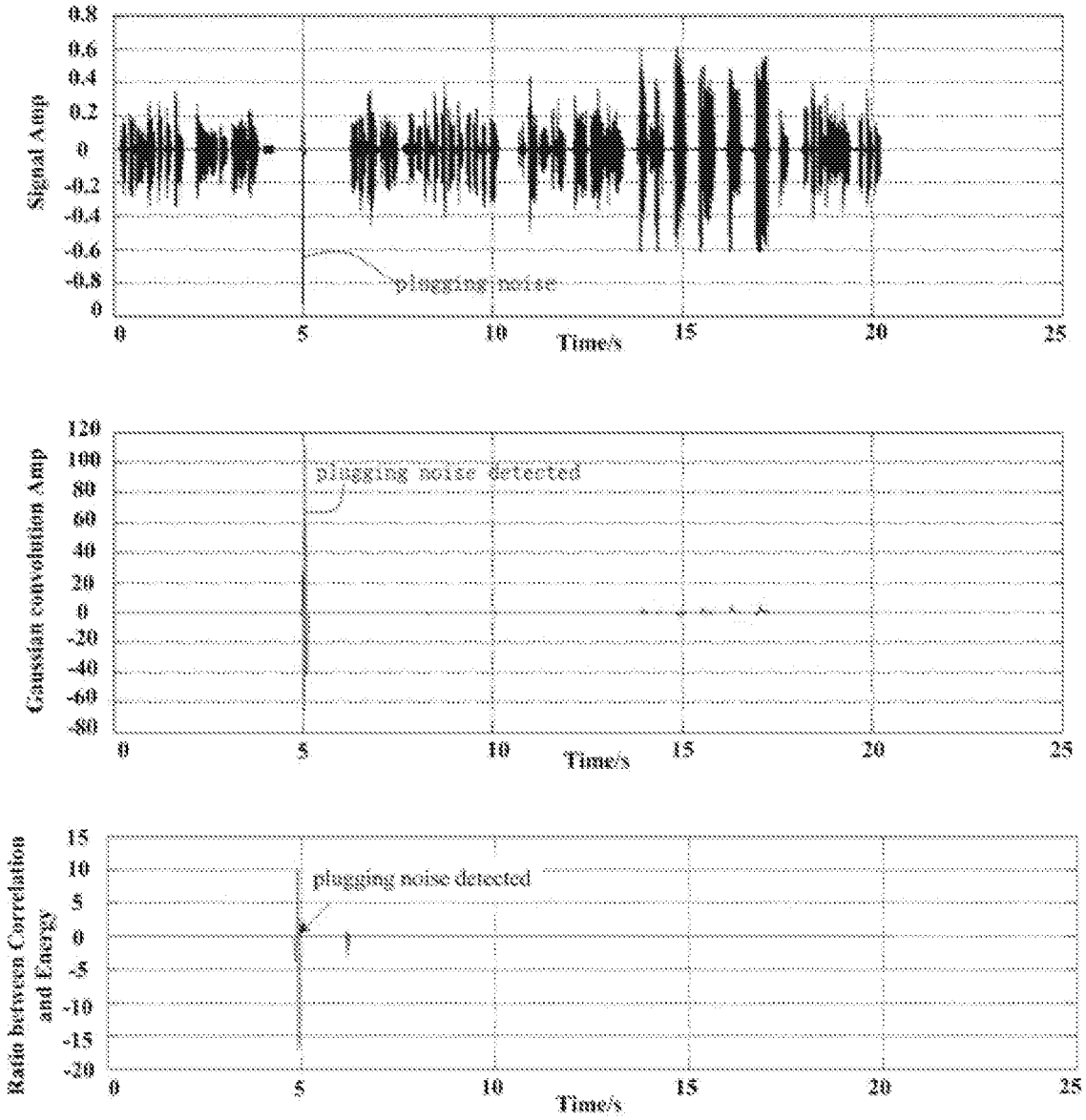
FIG. 3 schematically illustrates a curve of an audio signal, a curve of a correlation function, and a curve of a ratio of the correlation value to an energy value of the audio signal according to an embodiment.

In some embodiments, the ratio of the correlation value to the energy value of the audio signal is compared with a first threshold value to identify whether the audio signal is a candidate noise signal. For example, as shown in FIG. 3, if the ratio at the time point of 5 s is greater than the first threshold value, the audio signal at the time point of 5 s is determined to be a candidate noise signal. Otherwise, the audio signal at the time point of 5 s is determined not to be a candidate noise signal. In some embodiments, the first threshold value is obtained based on a plurality of plugging noise samples. For example, the first threshold value may be greater than 5.

In other embodiments, the noise model may be a Marr window function, or other window functions which have a similar waveform to the plugging noise. Parameters of these window functions may be extracted from a plurality of plugging noise samples.

Referring to FIG. 1, the processing device 120 may further include a noise reduction unit 122 to form a noise reduction system. The noise reduction unit 122 may perform a noise reduction process on the candidate noise detected by the correlation value estimator 121. For example, a fade-out process may be performed at the beginning of the candidate noise signal to gradually reduce the candidate noise signal, and a fade-in process may be performed at the end of the candidate noise signal to gradually increase the audio signal. The fade-out process and the fade-in process may employ a linear fade curve, a logarithmic fade curve or an exponential fade curve.

Figure 4:
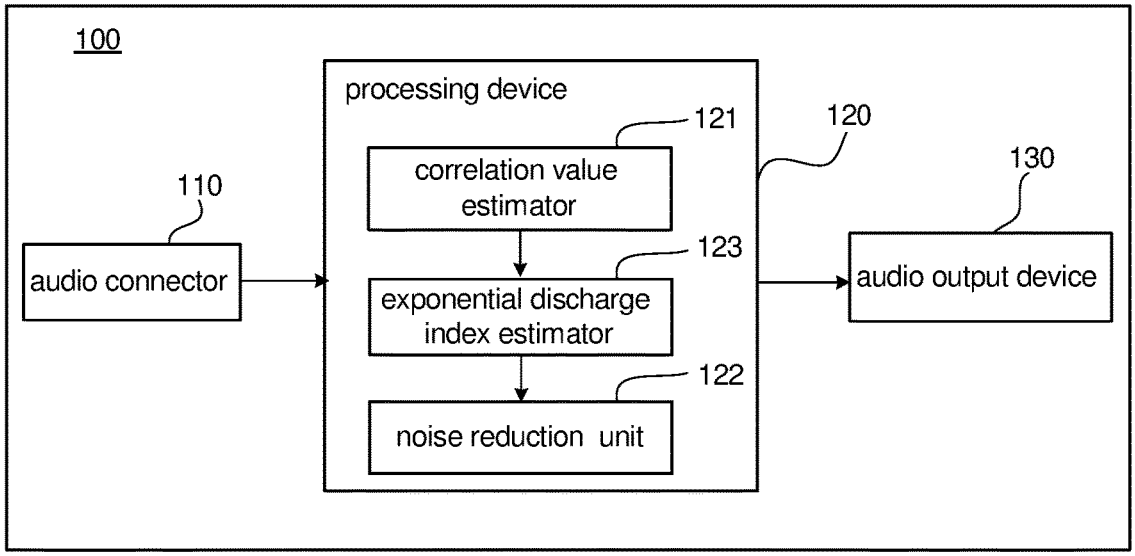
FIG. 4 schematically illustrates a block diagram of an audio player with a noise detection system according to another embodiment.

In another embodiment, referring to FIG. 4, the processing device 120 may further include an exponential discharge index estimator 123. The exponential discharge index estimator 123 is configured to obtain an exponential discharge index of the candidate noise signal, and compare the exponential discharge index with a second threshold value. If the exponential discharge index is smaller than the second threshold value, the exponential discharge index estimator 123 identifies the candidate noise signal to be a noise signal. Otherwise, the exponential discharge index estimator 123 identifies the candidate noise signal not to be a noise signal.

Because the plugging noise is generated by a resistor-capacitor circuit (RC circuit) consisting of the audio plug and the audio socket, the discharging process can be expressed as the following equation:

$$V(t) = V_0 e^{-\frac{t}{RC}};$$

where R represents a resistance, C represents a capacitance, V(t) represents a voltage across the capacitor, and $V_0$ represents the voltage across the capacitor at time t=0. A time required for the voltage to fall to $V_0/e$ is called the RC time constant, and is given by an equation: τ=RC. As the plugging noise is generated by plugging the audio plug 110 into the audio socket 142, the time constant r can be limited in a certain range.

In some embodiments, in order to obtain the exponential discharge index of the candidate noise signal, the candidate noise signal can be written as an equation:

$$S(t) = Ve^{-\frac{t}{\tau}}.$$

First, the exponential discharge index estimator 123 is configured to calculate derivative of the candidate noise signal to obtain a derivative function:

$$S'(t) = V * \left(-\frac{1}{\tau}\right) * e^{-\frac{t}{\tau}}.$$

Then, the exponential discharge index estimator 123 is configured to calculate logarithm of an absolute value of the derivative function to obtain a logarithm function:

$$LS(t) = \log(|S'(t)|) = \log\left(\frac{V}{\tau}\right) + \left(-\frac{t}{\tau}\right).$$

At last, the exponential discharge index estimator 123 is configured to calculate derivative of the logarithm function: LS'(t)=−1/τ. Accordingly, the RC time constant τ, namely, the exponential discharge index, is obtained.

In some embodiments, the exponential discharge index estimator 123 compares the exponential discharge index with the second threshold value. The second threshold value is extracted from a plurality of plugging noise samples. For example, the second threshold value may be obtained by calculating an average value of exponential discharge indexes of a plurality of plugging noise samples. In some embodiments, the second threshold value may range from 5 to 15. For example, the second threshold value may be 10.

Figure 5:
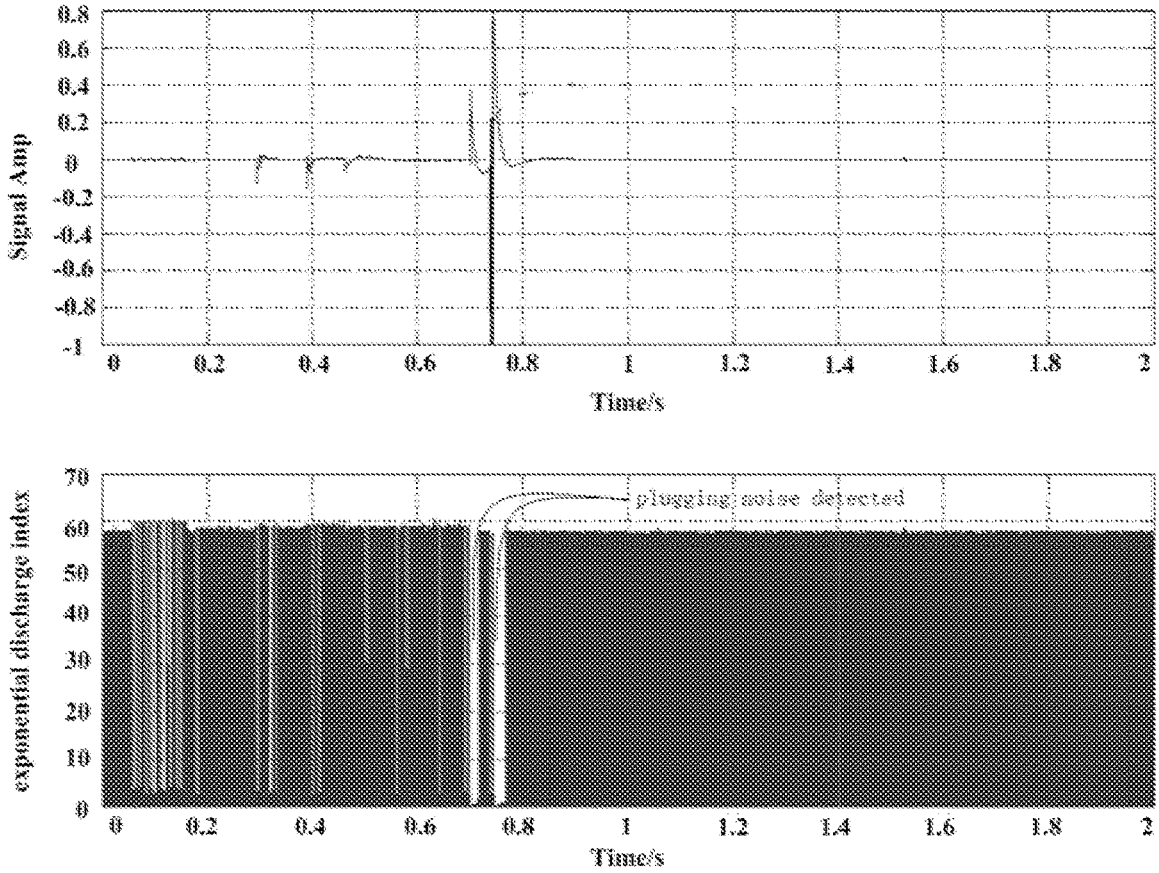
FIG. 5 schematically illustrates a curve of an audio signal and a curve of the exponential discharge indexes according to an embodiment.

Referring to FIG. 5, the upper curve illustrates an audio signal, and the lower curve illustrates the exponential discharge indexes of the audio signal. It can be found from FIG. 5 that, the exponential discharge indexes around 0.75 s are lower than the second threshold value, and last a time period similar to a plugging noise. Therefore, the candidate noise signals around 0.75 s are determined to be noise signals.

Referring to FIG. 4, the processing device 120 also includes a noise reduction unit 122. The noise reduction unit 122 is configured to perform a noise reduction process on the noise signal identified by the exponential discharge index estimator 123. For example, a fade-out process may be performed at the beginning of the noise signal to gradually reduce the noise signal, and a fade-in process may be performed at the end of the noise signal to gradually increase the audio signal.

The noise detection system and the noise reduction method of the present disclosure include the processing device 120 of the above embodiments. By employing the noise detection system described above, the plugging noise can be detected effectively. Further, when the processing device 120 further includes the noise reduction unit 122, the plugging noise also can be reduced, which improves the quality of the audio signal.

The present disclosure further provides a noise detection method and noise reduction method.

Figure 6:
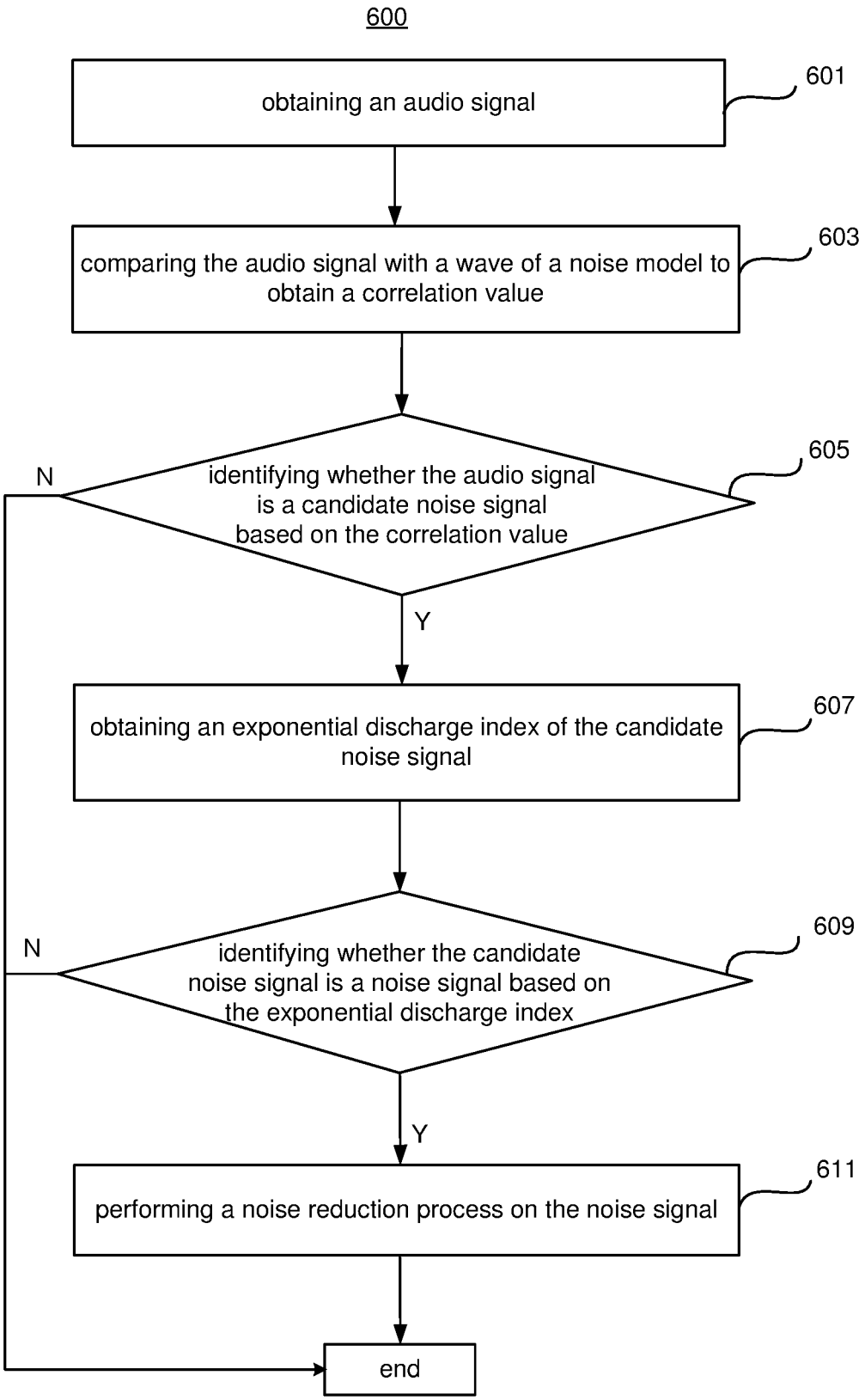
FIG. 6 schematically illustrates a flow chart of a noise detection method according to an embodiment.

FIG. 6 is a flow chart of a noise reduction method 600 according to an embodiment of the present disclosure. The noise detection method of the present disclosure includes 601-609 of the noise reduction method 600.

Referring to FIG. 6, in 601, an audio signal is obtained. In some embodiments, the audio signal may include a plugging noise, which is generated when an audio plug is being plugged into an audio socket.

In 603, the audio signal is compared with a wave of a noise model to obtain a correlation value.

In some embodiment, the audio signal is convoluted with the wave of the noise model to obtain the correlation value. The noise model may be a Gaussian window function, a Marr window function or other window functions which have a similar waveform to plugging noises. In some embodiments, the parameters of these window functions are extracted from a plurality of plugging noise samples.

In 605, it is identified whether the audio signal is a candidate noise signal based on the correlation value. If the audio signal is identified to be a candidate noise signal, the method goes to 607. If the audio signal is identified not to be a candidate noise signal, the method is ended.

In some embodiments, a ratio of the correlation value to an energy value of the audio signal is calculated, and then the ratio is compared with a first threshold value. If the ratio is greater than the first threshold value, the audio signal is identified to be a candidate noise signal. Otherwise, the audio signal is identified not to be a candidate noise signal. In some embodiments, the first threshold value may be extracted from a plurality of plugging noise samples.

In 607, an exponential discharge index of the candidate noise signal is obtained.

In some embodiments, derivative of the candidate noise signal is calculated to obtain a derivative function; then logarithm of an absolute value of the derivative function is calculated to obtain a logarithm function; and then derivative of the logarithm function is calculated to obtain the exponential discharge index of the candidate noise signal.

In 609, it is identified whether the candidate noise signal is a noise signal based on the exponential discharge index. If the candidate noise signal is identified to be a noise signal, the method goes to 611. If the candidate noise signal is identified not to be a noise signal, the method is ended.

In some embodiments, the exponential discharge index is compared with a second threshold value. If the exponential discharge index is smaller than the second threshold value, the candidate noise signal is identified to be a noise signal. Otherwise, the candidate noise signal is identified not to be a noise signal. In some embodiments, the second threshold value may be obtained by calculating an average value of exponential discharge indexes of a plurality of plugging noise samples.

It should be noted that 607 and 609 are optional. In some embodiments, 607 and 609 may not be performed.

In 611, a noise reduction process is performed on the noise signal.

In some embodiment, the noise reduction process may include a fade-in process and a fade-out process.

More detail about the noise reduction method can be found in the description of the audio player 100, and is not described herein.

According to one embodiment, a non-transitory computer readable medium, which contains a computer program for noise detection and reduction, is provided. When the computer program is executed by a processor, it will instructs the processor to: obtain an audio signal; convolute the audio signal with a Gaussian window function to obtain a correlation function; determine whether the correlation function has a value greater than a first threshold value; and if yes, determine an interval of the audio signal corresponding to the correlation function value to be a candidate noise signal.

There is little distinction left between hardware and software implementations of aspects of systems; the use of hardware or software is generally a design choice representing cost vs. efficiency trade-offs. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A noise detection method, comprising:

obtaining an audio signal at an electronic processing device;

comparing the audio signal with a wave of a noise model to obtain a correlation value at the electronic processing device; and identifying whether the audio signal is a candidate noise signal based on the correlation value, wherein comparing the audio signal with the wave of the noise model to obtain the correlation value includes convoluting the audio signal with the wave of the noise model to obtain the correlation value.

2. The method according to claim 1, wherein the noise model is a Gaussian window function or a Marr window function.

3. The method according to claim 2, Wherein parameters of the Gaussian window function or the Marr window function are extracted from a plurality of plugging noise samples.

4. The method according to claim 1, wherein identifying whether the audio signal is the candidate noise signal based on the correlation value comprises:

obtaining a ratio of the correlation value to an energy value of the audio signal;

comparing the ratio with a first threshold value; and identifying the audio signal to be the candidate noise signal if the ratio is greater than the first threshold value; and identifying that the audio signal is not the candidate noise signal if the ratio is not greater than the first threshold value.

5. The method according to claim 4, wherein the first threshold value is obtained based on a plurality of plugging noise samples.

6. The method according to claim 1, wherein if the audio signal is identified to be the candidate noise signal, the method further comprises:

obtaining an exponential discharge index of the candidate noise signal;

comparing the exponential discharge index with a second threshold value; and identifying the candidate noise signal to be a noise signal if the exponential discharge index is smaller than the second threshold value; and identifying the candidate noise signal not to be a noise signal if the exponential discharge index is greater than the second threshold value.

7. The method according to claim 6, wherein obtaining the exponential discharge index of the candidate noise signal comprises:

calculating derivative of the candidate noise signal to obtain a derivative function;

calculating a logarithm of an absolute value of the derivative function to obtain a logarithm function; and calculating a derivative of the logarithm function to obtain the exponential discharge index of the candidate noise signal.

8. The method according to claim 6, wherein the second threshold value is obtained by calculating an average value of exponential discharge indexes of a plurality of plugging noise samples.

9. A noise reduction method, comprising:

obtaining an audio signal at an electronic processing device;

comparing the audio signal with a wave of a noise model to obtain a correlation value at the electronic processing device;

identifying whether the audio signal is a noise signal based on the correlation value; and performing a noise reduction process on the audio signal if the audio signal is identified to be the noise signal, wherein comparing the audio signal with the wave of the noise model to obtain the correlation value includes convoluting the audio signal with the wave of the noise model to obtain the correlation value.

10. The method according to claim 9, wherein the noise reduction process comprises a fade-out process and a fade-in process.

11. A noise detection system comprising:

a microcontroller; and an electronic processing device including the microcontroller and being configured to:

obtain an audio signal;

compare the audio signal with a wave of a noise model to obtain a correlation value;

identify whether the audio signal is a candidate noise signal based on the correlation value; and convolute the audio signal with the wave of the noise model to obtain the correlation value.

12. The system according to claim 11, wherein the noise model is a Gaussian window function or a Marr window function.

13. The system according to claim 12, wherein parameters of the Gaussian window function or the Marr window function are extracted from a plurality of plugging noise samples.

14. The system according to claim 11, wherein the electronic processing device is further configured to:

obtain a ratio of the correlation value to an energy value of the audio signal;

compare the ratio with a first threshold value;

identify the audio signal to be the candidate noise signal if the ratio is greater than the first threshold value; and identify that the audio signal is not the candidate noise signal if the ratio is not greater than the first threshold value.

15. The system according to claim 14, wherein the first threshold value is extracted from a plurality of plugging noise samples.

16. The system according to claim 11, wherein, if the audio signal is identified to be a candidate noise signal, the electronic processing device is further configured to:

obtain an exponential discharge index of the candidate noise signal;

compare the exponential discharge index with a second threshold value;

identify the candidate noise signal to be a noise signal if the exponential discharge index is smaller than the second threshold value; and identify that the candidate noise signal is not the noise signal if the exponential discharge index is greater than the second threshold value.

17. The system according to claim 16, wherein the electronic processing device is further configured to:

calculate derivative of the candidate noise signal to obtain a derivative function;

calculate a logarithm of an absolute value of the derivative function to obtain a logarithm function; and calculate a derivative of the logarithm function to obtain the exponential discharge index of the candidate noise signal.

18. The system according to claim 16, wherein the second threshold value is obtained by calculating an average value of exponential discharge indexes of a plurality of plugging noise samples.

19. The system according to claim 11, wherein the electronic processing device is integrated in a headphone or a loudspeaker.

* * * * *